United States Patent [19]

Cram et al.

[11] 4,356,488

[45] Oct. 26, 1982

[54] DEVICE FOR INDICATING THE PROXIMITY OF A TARGET

[75] Inventors: Leonard A. Cram, Winscombe; Brian Jackson; Montague R. Gilday, both of Wells, all of England

[73] Assignee: Electric & Musical Industries Limited, Hayes, England

[21] Appl. No.: 111,395

[22] Filed: May 19, 1961

[30] Foreign Application Priority Data

May 20, 1960 [GB] United Kingdom ..... 17995/60

[51] Int. Cl.[3] ..... F42C 13/04

[52] U.S. Cl. ..... 343/7 PF

[58] Field of Search ..... 343/7, 5, 13, 112.4, 343/7 PF; 244/14

[56] References Cited

U.S. PATENT DOCUMENTS

| | | | |
|---|---|---|---|
| 3,046,892 | 7/1962 | Cosse et al. | 343/7 PF X |
| 3,408,938 | 11/1968 | Pagazani et al. | 343/7 PF |
| 3,877,377 | 4/1975 | Rabinow | 343/7 PF X |
| 4,159,476 | 6/1979 | Kohler | 343/7 PF |

*Primary Examiner*—T. H. Tubbesing

*Attorney, Agent, or Firm*—Fleit & Jacobson

[57] ABSTRACT

A device for indicating the proximity of a target comprising means for setting up at least an approximate representation of the direction of the velocity of the target relative to an axis fixed in relation to the device, and signalling means responsive to the direction of the target from the device, namely the sight line of the target for the angle producing an output signal when/between the sight line and the relative velocity direction increases to a predetermined value.

1 Claim, 5 Drawing Figures

Figure 1:
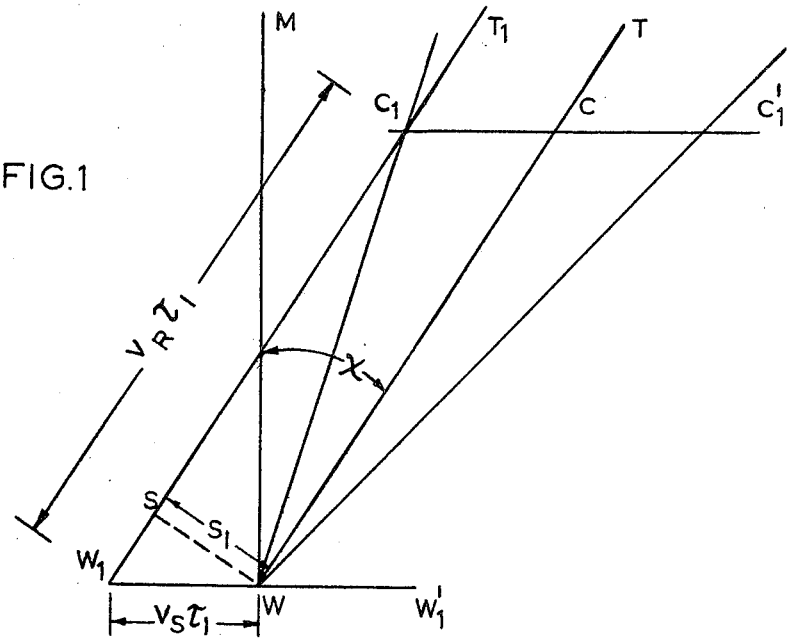

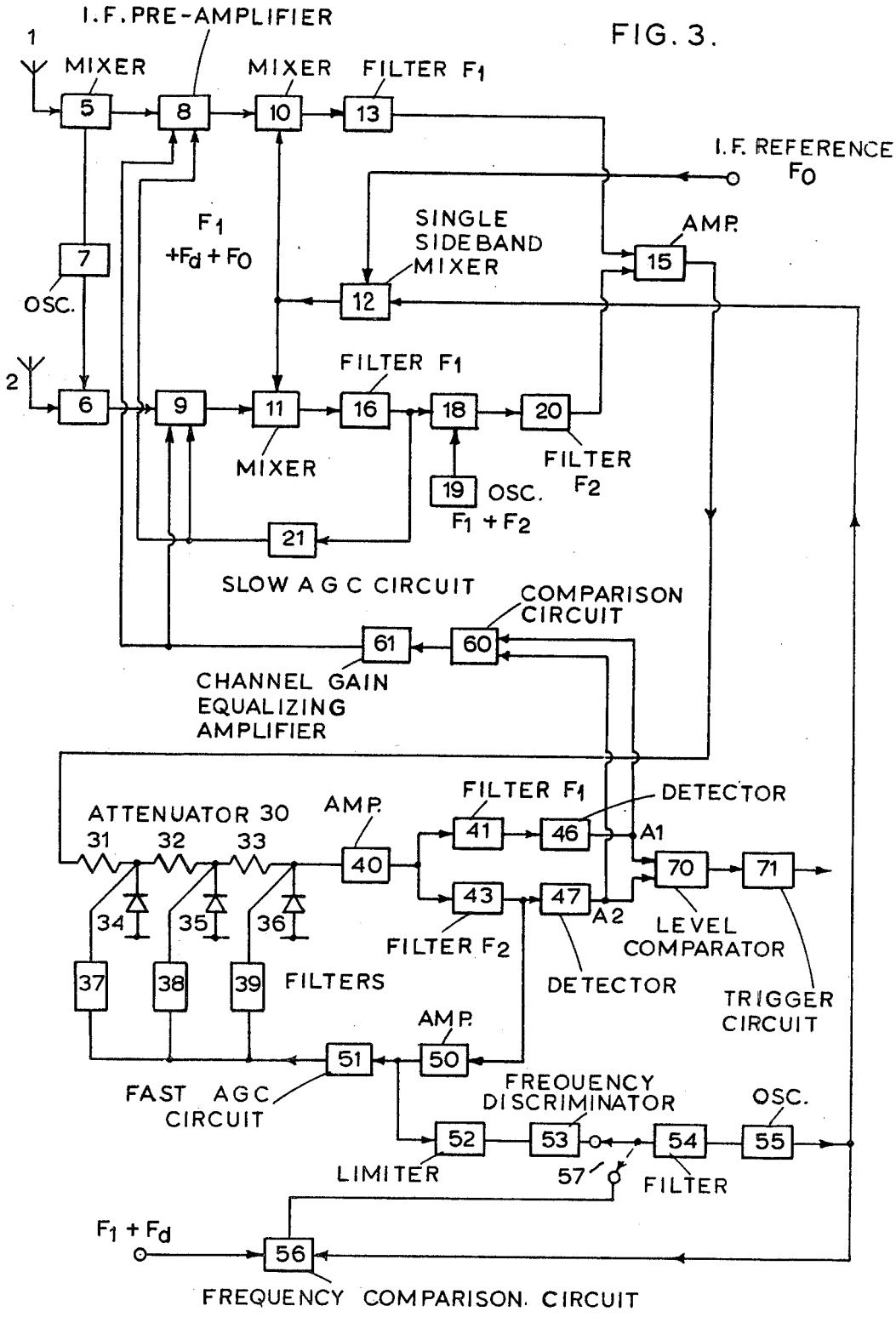
FIG. 3.
I.F. PRE-AMPLIFIER
1
MIXER
MIXER
FILTER F1
5
8
10
13
I.F. REFERENCE
F0
F1
+Fd + F0
SINGLE
SIDEBAND
MIXER
AMP.
7
15
OSC.
12
2
FILTER F1
6
9
11
16
18
20
MIXER
FILTER
F2
19
OSC.
F1 + F2
21
SLOW A G C CIRCUIT
COMPARISON
CIRCUIT
61
60
CHANNEL GAIN
EQUALIZING
AMPLIFIER
FILTER F1
DETECTOR
ATTENUATOR 30
AMP.
31
32
33
41
46
A1
40
70
71
43
47
A2
34
35
36
FILTER F2
LEVEL
COMPARATOR
37
38
39
FILTERS
DETECTOR
TRIGGER
CIRCUIT
AMP.
51
50
FAST AGC
CIRCUIT
FREQUENCY
DISCRIMINATOR
OSC.
52
53
54
55
LIMITER
57
FILTER
F1 + Fd
56
FREQUENCY COMPARISON. CIRCUIT

DEVICE FOR INDICATING THE PROXIMITY OF A TARGET

This invention relates to a device for indicating the proximity of a target and it relates especially though not exclusively to devices for producing a fuze firing signal in guided missiles.

Fuzing devices which have been proposed hitherto for guided missiles have often been arranged in such a way that firing is initiated at the instant when the target passes the missile. Such an arrangement gives satisfactory performance when the missile axis can be assumed to be nearly parallel with the vector representing the velocity of the target relative to the missile and when the warhead from the missile is ejected at a rate which is high compared with the velocity magnitude. However these conditions do not always apply, for example with fast missiles, fast targets, missiles which pitch and yaw appreciably or with slower warhead ejection rates and to deal with the situation which then arises, proposals have been made to design so called predictor fuzes which provide fore-knowledge of the instant of closest approach. However previous predictor fuzes have not proved satisfactory for some applications, especially for missiles in which firing has to be initiated an appropriate time before the instant of nearest approach of missile to target.

While the invention is especially applicable to devices for producing fuze firing signals in missiles it is nevertheless also useful for devices for firing from the ground or ship at low flying targets.

According to the present invention there is provided a device for indicating the proximity of a target comprising means for setting up at least an approximate representation of the direction of the velocity of the target relative to an axis fixed in relation to the device, and signalling means responsive to the direction of the target from the device namely the sight line of the target, for producing an output signal when the angle between the sight line and the relative velocity direction increases to a particular value. The invention is based on the appreciation of the fact that for a particular magnitude of the relative velocity vector the surface of the cone whose axis is parallel to the relative velocity direction will be intercepted by the target when the time before the target passes through the plane fixed relative to the missile, normal to the missile axis and containing the apex of the cone is approximately proportional to the miss distance in that plane. This relationship therefore provides a reliable fuzing criterion for the missile since devices ejected from the missile at the instant of said intercepted and travelling outwards in said plane with a known velocity or velocity range may intercept the target.

The production of the output signal may be dependent upon observation of the sight line of the target, and of the magnitude and direction of the velocity of the target relative to the missile.

Alternatively the production of the output signal may be dependent only upon the sight line of the target and the direction but not the magnitude of the velocity of the target relative to the missile. This form of the invention is applicable especially to missiles having a warhead containing a plurality of devices which are ejected with different velocities, and is also applicable to missiles intended for encounters with large targets.

According to the present invention, looked at from a different aspect, there is provided a device for indicating the proximity of a target comprising a plurality of target sensing means for producing signals in response to the presence of a target in different regions of space, which regions have a common axis, a first said sensing means being arranged to produce a signal in response to the presence of a target in a first region which diverges increasingly from said axis with increasing distance along the axis from said first sensing means, a second said sensing means being arranged to produce a signal in response to the presence of a target in a second region which diverges increasingly and to a greater extent than said first region from said axis with increasing distance along the axis from said second sensing means, and circuit means responsive to signals from said first and second sensing means to provide an output signal in response to a target passing outwardly from said first region.

Figure 2:
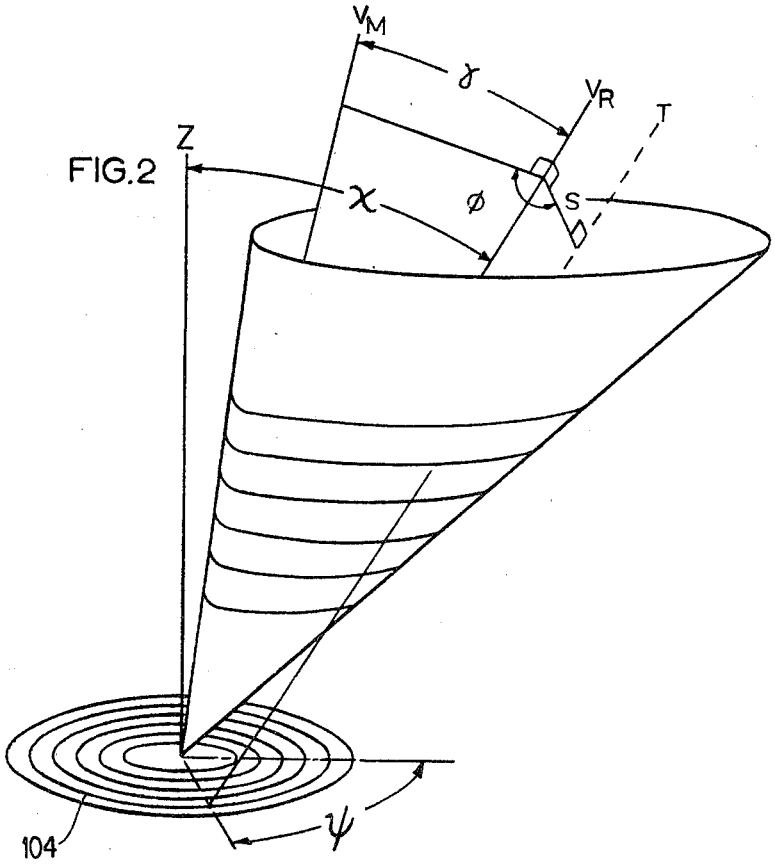
Figure 4:
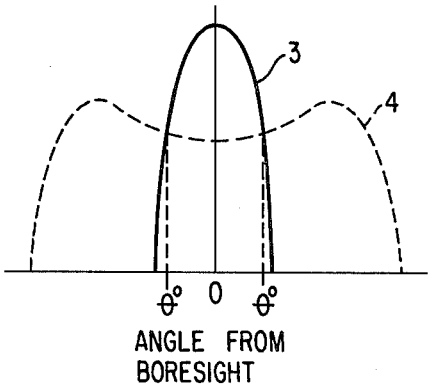
Figure 3A:
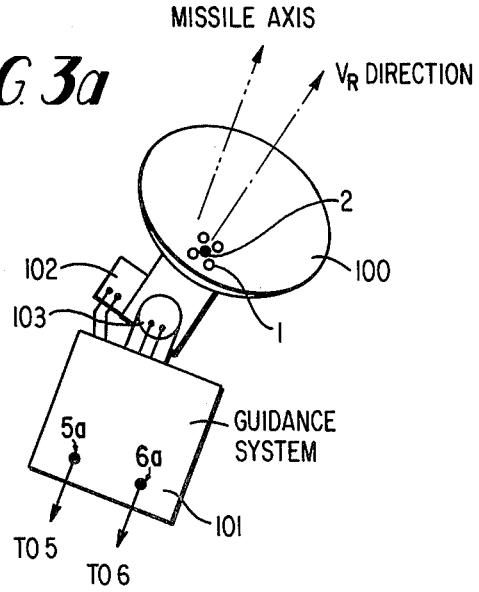

In order that the present invention may be clearly understood and readily carried into effect, it will now be described with reference to the accompanying drawings, in which:

FIG. 1 is a geometric diagram which will be used for the purpose of explaining the principle on which the present invention is based, FIG. 2 is another geometric figure which will be used for the same purpose, FIG. 3 illustrates a fuzing device according to one example of the present invention, FIG. 3*a* illustrates an associated part of the device illustrated in FIG. 3, FIG. 4 illustrates idealized response curves for the two aerials of the receiving circuit shown in FIG. 3, In FIG. 1, the point W represents the position of the section or "bay" of a missile in which the warhead is carried and the axis of the missile is represented by the line WM. The missile is of a kind in which one or more devices, constituting a warhead is or are ejected when a fuzing signal is generated. Assume that ejection is perpendicular to the axis WM and occurs with a velocity $V_S$. After time $\tau_1$ seconds the warhead lies in a ring of radius $V_s \tau_1$ indicated by $W_1$ and $W'_1$ in the drawing. Consider a target approaching with a velocity $V_R$ along a relative velocity vector parallel to TW at an angle $\chi$ to MW. In the general case the target will miss the point W and for target vector $T_1 W_1$ the miss distance $S_1$ is represented by WS, perpendicular to $W_1 T_1$. From the drawing it is evident that the target $T_1$ approaching along $T_1 W_1$ will not be hit by the warhead at the point S, the point of nearest approach to the missile but it can be hit at $W_1$ if the ejection of the warhead occurs $\tau_1$ seconds earlier. At that time the target was at a distance $V_R \tau_1$ from $W_1$, that is, the target was at the point $C_1$ as shown on the drawing. Therefore for a target approaching parallel to TW which wll be hit $\tau_1$ seconds after ejection of the warhead, the locus of points representing target positions at which the warhead ejection should occur is a circle with diameter $C_1 C_1'$ in a plane parallel to the warhead plane, the latter being the plane perpendicular to the missile axis containing W, $W_1$ and $W_1'$. The circle with diameter $C_1 C_1'$ is called an initiation circle. Moreover the locus of the initiation circles for other values of $\tau$ is the conical surface with apex at W containing the circle diameter $C_1 C_1'$.

Any target approaching parallel to TW with any miss distance will, therefore, be hit when it reaches the warhead plane $W_1 W_1'$ if warhead ejection occurs when the target intersects the surface of the cone $C_1 W_1 C_1'$. For other directions of approach a different fuzing cone of course exists. In general, this family of cones consists of oblique circular cones which intersect any plane parallel to the warhead plane in a circle and the centers of these circles lie on the line through the warhead bay at W parallel to the relative velocity direction. The shape of the fuzing cone is defined by the direction of $V_R$ with respect to the missile axis, that is the angle $\chi$ and by the radius of the circle $C_1 C_1'$ which radius is a function of $V_S/V_R$, the ratio of the speed of the warhead (relative to the missile) to the speed of the target (relative to the missile).

The cone surface for particular values of $V_R$, $V_S$ can be specified in terms of direction cosines as follows:

$$\left(\frac{1}{n} - \frac{1_R}{n_R}\right)^2 + \left(\frac{m}{n} - \frac{m_R}{n_R}\right)^2 = \left(\frac{V_S}{n_R V_R}\right)^2$$

In this equation 1, m, n are direction cosines of the sight line from the missile to the target and $1_R$, $m_R$ and $n_R$ are the direction cosines of the relative velocity vector $V_R$, the co-ordinate axes being drawn in such a way that the direction cosines n and $n_R$ are with respect to the missile axis WM.

According therefore to the invention means may be provided for observing the direction of the sight line to the target and setting up electrical signals representing the direction cosines, other means are provided for observing the direction of the relative velocity vector and setting up electrical signals representing the respective direction cosines, and other means are provided for observing the magnitude of the relative velocity vector and setting up an analogous electrical signal. The missile is provided with a computer which may make use of known computing components, and which is fed with the aforesaid signals. It is arranged furthermore to produce an output signal for initiating warhead ejection when equality occurs between two sides of the equation set out above. It will be understood that equality arises at the instant when the target intersects the fuzing cone, or in other words when the sight line of the target becomes co-incident with a generator of the cone.

However the invention may also be carried into effect using apparatus by which the magnitude of the relative velocity vector is not in fact observed but a probable value is assumed and in this case, the instant for initiation of warhead ejection is again determined by an output signal from the computer indicating that the sides of the aforesaid equation have become equal, using the assumed value of $V_R$. In this case however a warhead comprising different devices ejected with different velocities is preferably employed to cover the possible range of spread of the actual target relative velocity about the assumed value.

Moreover it has been found that satisfactory performance can be achieved if the fuzing cone is assumed to be a right circular cone, even if the semi-angle of the cone $\gamma$ (FIG. 2) is left unchanged for a substantial range of magnitudes of $V_R$. This approximation enables the fuzing device to be considerably simplified and in the preferred example of the invention which is illustrated in FIGS. 3 and 4, the design of the fuzing device is based on the use of this approximation. In this example a fuzing signal is generated when a target penetrates the surface of a right circular cone having a predetermined semi-angle $\theta$ (indicated in FIG. 4), the right circular cone having its axis parallel with the $V_R$ direction.

The example of the fuzing device which is illustrated in FIG. 3 was designed to be carried by a semi-active homing or guidance missile. The homing system in the missile is responsive to continuous radio waves transmitted from a ground transmitter (the so-called lamp set) and reflected from the target. For the purpose of receiving the reflected radio waves, the missile carries as represented in FIG. 3*a* a so-called guidance dish 100 which, as the missile homes on the target, is orientated by the guidance system 101 of the missile so that the axis of the dish is aimed at the target. For the purpose of operating the fuzing device, it is assumed that the bore-sight of the dish represents the $V_R$ direction, which is approximately true while the missile is still a substantial distance from the target. As the missile approaches and moves past the target, the guidance dish will attempt to follow the target, with however a maximum rate determined by the time constant of the dish servo system 102, 103. This movement of the bore-sight axis, introduces an error in the assumption that the bore-sight axis represents the $V_R$ direction but it has been found that this error is not large and is acceptable and can in some cases be reduced by inserting a fixed correction.

The receiving circuit of the fuzing device has two aerials 1 and 2 (FIGS. 3 and 3*a*) which have respectively narrow and broad beams. The homing system of the missile referred to in the preceding paragraph forms no part of the invention and is of known form. However advantage is taken of its existence to orientate the aerials 1 and 2 so that the axis of symmetry of the beam of each aerial approximately coincides with or is parallel to the $V_R$ direction. Thus, the beam of each aerial has circular symmetry about a common axis coincident with the bore-sight of the guidance dish, which bore-sight is indicated in FIG. 4. For example the response curve of the aerial 1 as a function of angle measured from the bore-sight may be as represented by the full line 3 in FIG. 4 whilst the response curve for the aerial 2 may be as represented by the dotted line 4. Thus for radio waves received from a source at an angle exceeding $\theta°$, the response of the aerial 2 is substantially greater than that of the aerial 1, but as the angle diminishes below $\theta°$ the response of the aerial 1 increases relative to that of the aerial 2 and substantially exceeds it for radio waves received along the common axis. It is to be borne in mind that the angles represent a series of right circular cones whose axes are parallel to the $V_R$ direction, on the aforesaid assumption with the $V_R$ direction is represented by the bore-sight of the guidance dish. It will therefore be apparent that when a missile approaches and moves past a target, the response of the aerial 1 to radio waves received from the target will initially be substantially greater than that of the aerial 2, but diminishes rapidly as the line of sight deviates as indicated in FIG. 3*a* from the bore-sight until the response of the aerial becomes equal to and then exceeds the response of the aerial 1. A fuze firing signal is produced when the response of the two aerials are in predetermined ratio. The aerial 2 may for example comprise a single di-electric rod and the aerial 1 may comprise four di-electric rods symmetrically positioned around the single rod constituting the aerial 2. The two aerials may then be mounted on a small platform in front of the guidance dish.

Radio waves received by the aerials 1 and 2 are applied to mixers 5 and 6 in which they are heterodyned by local oscillations from an oscillator 7. In FIG. 3*a* the leads from the aerials 1 and 2 are not shown but are assumed to emerge from the guidance system 101 at the points 5*a* and 6*a* and to pass thence to the mixers 5 and 6. The oscillator 7 may in fact be part of the guidance system for the missile. The intermediate frequency outputs from the mixers 5 and 6 have frequency $F_o+F_d$, where $F_o$ is determined by the frequency of the radio waves emitted by the ground transmitter and by the frequency of the oscillator 7 and $F_d$ represents the doppler frequency due to the relative velocity of the missile and target. In other words, the frequency of the oscillator 7 is such that when mixed with the frequency of the ground transmitter it produces a frequency $F_o$, which is the intermediate frequency of the system. The outputs from 5 and 6 are amplified in intermediate frequency pre-amplifiers 8 and 9 and then passed to further mixers 10 and 11. The heterodyning oscillations for the mixers 10 and 11 have a frequency of $F_l+F_d+F_o$ where $F_1$ represents a fixed frequency, and $F_d$ and $F_o$ are as defined above. The oscillation which is applied to the mixers 10 and 11 is obtained from one side band of the output of a mixer 12, which receives a reference oscillation of frequency $F_o$ (possibly from the guidance system) and also an oscillation of frequency $F_l+F_d$ from a Doppler tracking circuit which will be referred to subsequently. The component of Doppler frequency $F_d$ has the effect that the frequencies of the outputs of the mixers 10 and 11 are substantially independent of relative velocity between the target and the missile. The output of the mixer 10 is applied to filter 13 which has a relatively narrow pass band centered on the frequency $F_1$, namely the difference in frequency between the two oscillations applied to the mixers 10 and 11. The frequencies of the heterodyne oscillations fed to the mixers 5 and 10 respectively is such as to cause radio waves to appear in the output of the filter 13 the amplitude of which radio waves depends upon the amplitude of the radio waves from the lamp set reflected by the target and upon the response of the aerial 1. The output of the filter 13 is applied to an amplifier 15. Similarly the output of the mixer 11 is passed to filter 16 which corresponds to the filter 13. The amplitude of the radio waves which appear in the output of the filter 16 depends upon the amplitude of the radio waves from the lamp set reflected by the target and upon the response of the aerial 2. The relative amplitudes of the outputs from the filters 13 and 16 therefore depend upon the angle between the bore sight of the dish 100 and the line of sight from the target to the missile. However the output of the filter 16 before being passed to the amplifier 15 is again changed in frequency so as to cause it to have a different frequency from the radio waves passed to the amplifier 15 from the aerial 1. This last mentioned frequency changing is performed in a mixer 18 which receives a heterodyning oscillation having a frequency of $F_1+F_2$ produced by an oscillator 19, the mixer being followed by a filter 20 arranged to pass a frequency of $F_2$. Radio waves received from the target by the aerial 2 are therefore passed to the amplifier 15 with a frequency of $F_2$.

The intermediate frequency pre-amplifiers 8 and 9 receive two gain control signals, one of which is received from a slow automatic gain control circuit 21, the input of which is received from the filter 16. The pre-amplifiers 8 and 9 are used to give a good signal-to-noise ratio but their gain is low so as to keep the level of interfering signals below the level of the oscillation applied in the mixers 10 and 11. The slow automatic gain control applied to the amplifiers 8 and 9 is used to compensate for the distance of the engagement from the lamp-set and for the mean echo area of the target.

The spectrum of frequencies amplified by the amplifier 15 is applied to an attenuator denoted in general by the reference 30. This comprises series resistors 31, 32 and 33 and shunt diodes 34, 35 and 36, the conductances of which are controlled respectively by output signals obtained from smoothing filters 37, 38 and 39, whereby the attenuation of the network can be controlled over a substantial range, giving fast acting automatic gain control. The spectrum of frequencies is then amplified in a further amplifier 40 which has a frequency range including $F_1$ to $F_2$. The output of the amplifier 40 is passed to two filters 41 and 43 which have pass bands centred respectively at $F_1$ and $F_2$. The outputs of these filters are in turn passed to detectors 46 and 47 which produce two low frequency signals which represent respectively the amplitude of radio waves from the lamp set reflected by the target and picked up by the aerial 1 and the amplitude of the aforesaid radio waves picked up by the aerial 2. These signals are denoted respectively in the drawing as signal A1 and signal A2.

The attenuator 30 is included in a fast A.G.C. loop, the control signal for this loop being dependent upon the amplitude of the output signal from the filter 43, that is the amplitude of the aforementioned radio waves received by the aerial 2. A sample of the output of this filter is applied to an amplifier 50, and thence to an A.G.C. circuit 51 which provides the input signal for the filters 37 to 39. The A.G.C. signal provided by the circuit 51 controls, as aforesaid, the conductance of the diodes 34 to 36 and hence the attenuation of the attenuator 30. The effect of the fast A.G.C. loop including the attenuator 30 is to tend to maintain the signals A1 and A2 within a given amplitude range at the output of the detectors 46 and 47 even when the amplitudes of the signals being received by the aerials 1 and 2 are changing rapidly. As will appear subsequently the signals A1 and A2 are applied to a level comparator 70 which determines the fuzing criterion.

The doppler tracking circuit which, as described above, provides one input for the single side band mixer 12, also receives as its input a sample of the output of the filter 43, via the amplifier 50. A portion of the output of the amplifier 50 is applied to an amplitude limiter 52, the output of which, free from amplitude modulation, is applied to a frequency discriminator 53. This discriminator provides an output signal which varies in magnitude and polarity in accordance as the signal applied from the limiter 52 varies in frequency above and below $F_2$. Rate memory is provided by means of a filter 54 which smooths the output of the discriminator 53 and the output signal from the filter 54 is in turn employed to control the frequency of an oscillator 55, whose frequency may be varied in the range from $F_d$ min. $+F_1$ to $F_1+F_d$ max. To enable the fuzing device to be locked initially to the doppler frequency associated with a desired target, an initial lock may be provided from the doppler frequency oscillator of the guidance system. Thus a signal of doppler frequency plus $F_1$ derived from the guidance receiver can be applied as one input to a frequency comparison circuit 56, which receives a second input from the oscillator 55. A switch 57 is also provided whereby the output of the comparison circuit 56 may be applied to the filter 54 in place of the output of the frequency discriminator 53. By controlling the switch automatically (in known manner) in response to the output of the frequency discriminator 53, the filter 54 may be arranged to receive its input selectively from these two circuits.

The two channels of the receiver of the fuzing device, associated respectively with the aerial 1 and the aerial 2, are matched in gain by automatic gain control provided by the circuits 21 and 51 in order to achieve a high degree of angular accuracy at the firing point. Furthermore samples of the detected signal A1 and the detected signal A2 are applied to an amplitude comparison circuit 60 the output of which is arranged to represent in magnitude and polarity, the difference in amplitude level between the signals A1 and A2. The output of the comparison circuit 60 is amplified in the amplifier 61 and applied as a differential A.G.C. signal to the intermediate frequency amplifiers 8 and 9. In this way the pre-amplifier gains are controlled to tend to maintain the difference in level of the signals A1 and A2, equal with a time constant of the order of 1 second. As a result of the various provisions described slowly varying signals in the two channels are modified so that A1 and A2 tend to remain unchanging at the output of 46 and 47 (that is when the missile and target are relatively far apart) whilst rapid relative signal variations such as will occur as the firing time is approached, produce corresponding variations in A1 and A2. The slow gain control of the intermediate frequency amplifiers 8 and 9 provided by the circuit 21 has a longer time constant than the channel gain equalizing circuit 60 and 61 so that the latter compensates for any difference in the A.G.C. characteristics of the amplifiers 8 and 9, as well as for long term drifts in the channel gains due to temperature fluctuations etc.

The output circuit is arranged to provide an output fuze firing signal only in response to a true target which appears initially at the bore-sight of the guidance dish and moves off axis at greater than a defined rate. The output circuit produces no response to sources, the bearing angle of which varies more slowly than the rate predetermined by the time constant of the channel gain equalizing circuit 60 and 61.

The output circuit comprises a level comparator 70, the signal A1 and the signal A2 being applied to it. The comparator 70 provides an output signal to the trigger circuit 71 if the ratio of the level of signal A1 to that of signal A2 is a predetermined ratio corresponding to the predetermined angle $\theta$ as shown in FIG. 4.

An output signal from the trigger circuit 71 constitutes a fuze firing signal.

Many modifications may be made in other practical forms of the fuzing devices according to the invention.

The invention is not confined to the particular type of missile or guidance system described. For example, the means for observing the sight line of the target may be of other types and may be sensitive to visible or infra red emission instead of radio emission. A detector sensitive to radio emission may be associated with a transmitter, carried with the receiver, for directing radio frequency energy at the target. If an infra red sensitive detector is employed, the detector may consist of a series of concentric circular zones of infra red sensitive material as represented by the circles 104 in FIG. 2 so that they lie in a plane parallel to the warhead. Information as to the direction of the relative velocity vector derived from the respective observing means, is employed to adjust the optical system or the circular zones of the detector so that the direction of the relative velocity vector is always imaged in the center of the concentric infra red sensitive zones. The computer of the fuzing device is then arranged to connect that zone corresponding to the initiation radius for the observed velocity of the target relative to the missile so that when an output is obtained from the selected zone, it indicates the correct time for generating the fuzing signal. Such an observing means may however be simplified, as regards the optical system, if the concentric infra red zones (denoted by 104 in FIG. 2) are mounted on a surface which is maintained normal to the direction of the relative velocity vector rather than to missile axes, in a manner analogous to the guidance dish 100 of FIG. 3*a*. The error introduced by this simplification may usually be ignored but may be corrected for example by deriving a signal representing the angle of miss around the relative velocity vector $V_M$ with respect to the common velocity plane from the guidance circuit of the missile, and employing that signal to select the detector zone radius which satisfies the fuzing criterion in this direction only. The angle of miss is usually termed the $\Phi$ angle and is so denoted in FIG. 2, and the desired signal is often available in the guidance circuit. Alternatively the fuze itself may have means for measuring $\Phi$ so as to make this correction, or it may have its infra red zones cut into sectors such that the operable portions in any particular situation can be chosen from an approximate ellipse as required by the existing $\chi$ angle and $V_S/V_R$ ratio. In FIG. 2, $\psi$ represents the angle between the miss direction in the warhead plane and a reference axis in the missile.

Moreover, other means than the guidance system for the missile may be provided for observing the direction of the relative velocity vector $V_R$. For example, means may be provided for computing the $V_R$ direction in response to signals representing the rate of change of sight line direction.

Another possible form of means for observing the direction of the relative velocity vector $V_R$ comprises means for storing signals representing the direction of the sight line when the target is at some particular range from the missile, which range may be fixed or may be varied in response to the magnitude of the relative velocity, or the space rate of change of sight line, or the miss distance, signal to noise ratio or some other such parameter. According to yet another form, the means for observing the direction of $V_R$ comprises means for storing the sight line at the instant when a certain rate of turn of sight line occurs.

Furthermore if the missile is arranged to follow a radar or other beam directed from a guidance transmitter, the $V_R$ direction may be derived in the missile by making use of the fact that the direction of the beam is usually substantially coincident with the direction of the relative velocity vector.

If the magnitude of $V_R$ is not assumed to be within prescribed limits, means for observing the magnitude of the relative velocity vector $V_R$ may be provided and this may be of many different forms and the particular form selected may be dependent on the construction of other components of the missile or fuze. For example the means for observing the $V_R$ magnitude may comprise means for measuring the Doppler frequency of radar signals received either by the fuzing device or the guidance circuit of the missile. Alternatively if the missile is provided with means for measuring range, the rate of change of range may be employed to provide a signal representing the $V_R$ magnitude. According to another example, the $V_R$ magnitude is obtained by observing the Doppler frequency or the range rate of signals reflected by the target, from a guidance transmitter, separate from the missile, correcting means being provided to allow for the angles between the lines joining the transmitter, the missile and the target. Measurement of these angles may be aided by a gyroscope or by a direction sensitive instrument in the tail of the missile. According to another example, the $V_R$ magnitude is determined by equipment at a guidance transmitter and appropriate signals are transmitted to the missile. According to yet another example the $V_R$ magnitude may be provided in response to a signal representing the speed of the missile and a signal representing the estimated speed of the target. The signal representing the speed of the missile may be derived from a pitot tube and auxiliary equipment, these components being usually provided in the missile in any case, and correction may be made for the angle between the missile axis and the relative velocity vector and for pitch and yaw of the missile. The computer for effecting evaluation of the $V_R$ magnitude may be constructed according to known principles. The target speed may alternatively be supplied to the missile by a guidance transmitter either before launching or during flight.

Having regard to the foregoing description, it will be appreciated that in the device illustrated in FIGS. 3 and 3*a*, the dish 100 which is orientated through the servo system 102, 103 by the guidance system 101 constitutes means for setting up at least an approximate representation of the direction of the velocity of the target, relative to an axis fixed in relation to the device. Moreover, the circuit connections from the aerials 1 and 2 to the level comparator 70 constitute means responsive to the direction of the sight line of the target for producing an output signal in response to a desired relationship of angle between the sight line and the relative velocity direction. Thus, the signals produced by the aerials 1 and 2 to the mixers 5 and 6 and the following circuit components differ in amplitude in dependence upon the angle between the sight line and the relative velocity direction, and the level comparator 70 produces an output signal when the amplitude ratio of the two signals produced by the aerials 1 and 2 denotes a desired relationship of angle between the sight line and the relative velocity direction.

What we claim is:

1. A device for indicating the proximity of a target comprising means for setting up at least an approximate representation of the direction of the velocity of the target relative to an axis fixed in relation to the device, and signalling means responsive to the direction of the target from the device, namely the sight line of the target for producing an output signal when/between the sight line and the relative velocity direction increases to a predetermined value.

2. A device according to claim 1 wherein said signalling means comprises means to produce an output signal when the target passes out through the surface of a cone, the semi-angle of which has said particular angle value.

3. A device according to claim 1 wherein said signalling means includes radiation-sensitive means for producing a signal responsive to the sight line of the target.

4. A device according to claim 3, said radiation-sensitive means comprising at least one radio aerial and means for modifying the frequency of signals produced by said aerial so as to substantially nullify doppler shift of the frequency of said last mentioned signals due to said relative velocity.

5. A device according to claim 3, wherein said signalling means includes different radiation sensitive means for producing two signals differently responsive to changes in the sight line of the target, and two receiving channels individually responsive respectively to said two signals, said receiving channels having common automatic gain control means responsive to the output signal of one of said channels.

6. A device according to claim 5 wherein said automatic gain control means comprises a first relatively slow acting gain control means to compensate for slow variations of circuit parameters, and to compensate for the distance of the target and the mean echoing area thereof, and a second relatively fast automatic gain control means to compensate for fast signal level variations.

7. A device according to claim 5 comprising further automatic gain control means responsive to the outputs of both said channels to compensate for differences in the gains of said channels.

8. A missile having a device according to claim 1 and having means for producing a fuze firing signal in response to said output signal.

9. A device according to claim 1 wherein said signalling means includes detecting means sensitive to energy received from the direction of the target for producing a signal responsive to the sight line of the target, a support on which said detecting means is mounted, and means for varying the orientation of the said support to orientate it approximately in accordance with the relative velocity direction whereby the signal output of said detecting means is responsive directly to the angle of the sight line relative to the relative velocity direction.

10. A device according to claim 9 wherein said detecting means comprises two radiation-sensitive means each having an amplitude response characteristic which is a function of the angle of the sight line relative to an axis fixed with reference to said support, said functions being different for the different radiation-sensitive means.

11. A device according to claim 10 wherein said radiation-sensitive means comprises means to cause said functions to have approximately circular symmetry about said axis fixed relative to said support.

12. A device for indicating the proximity of a target comprising a. a plurality of target sensing means for producing signals in response to the presence of a target in different regions of space, which regions have a common axis extending along each region, b. a first said sensing means being arranged to produce a signal in response to the presence of a target in a first region which diverges increasingly from said axis with increasing distance along the axis from said first sensing means, c. a second said sensing means being arranged to produce a signal in response to the presence of a target in a second region which diverges increasingly and to a greater extent than said first region from said axis with increasing distance along the axis from said second sensing means, d. and circuit means responsive to signals from said first and second sensing means to provide an output signal in response to a target passing outwardly from said first region.

13. A device for indicating the proximity of a target comprising a. a plurality of target sensing means for producing signals in response to the presence of a target in different regions of space, which regions have a common axis extending along each region, b. a first said sensing means being arranged to produce a signal in response to the presence of a target in a first substantially conical region having its apex adjacent said first sensing means, c. a second said sensing means being arranged to produce a signal in response to the presence of a target in a second substantially conical region having an apex angle exceeding said first conical region, and having its apex adjacent said second sensing means, d. and circuit means responsive to signals from said first and second sensing means to produce an output signal when the time before a target sensed by said sensing means passes through a plane normal to said axis and fixed in relation to said sensing means is approximately proportional to the miss distance in that plane from the axis of the target.

14. A device for indicating the proximity of a target comprising (a) a plurality of target sensing means for producing signals in response to the presence of a target in different regions of space, which regions have a common axis extending along each region, (b) a first said sensing means comprising means to produce a signal in response to the presence of a target in a first region which diverges increasingly from said axis with increasing distance along the axis from said first sensing means, (c) a second said sensing means comprising means to produce a signal in response to the presence of a target in a second region which diverges increasingly and to a greater extent than said first region from said axis with increasing distance along the axis from said second sensing means, (d) circuit means responsive to signals from said first and second sensing means to provide an output signal in response to a target passing outwardly from said first region and, (e) further means to prevent said circuit means from producing an output signal when the rate of passage of the target outwardly from said region is slower than a predetermined rate.

15. In a vehicle a device for indicating the proximity of a target comprising (a) a plurality of target sensing means for producing signals in response to the presence of a target in different regions of space, which regions have a common axis extending along each region, (b) a first said sensing means comprising means to produce a signal in response to the presence of a target in a first region which diverges increasingly from said axis with increasing distance along the axis from said first sensing means, (c) a second said sensing means comprising means to produce a signal in response to the presence of a target in a second region which diverges increasingly and to a greater extent than said first region from said axis with increasing distance along the axis from said second sensing means, (d) circuit means responsive to signals from said first and second sensing means to provide an output signal in response to a target passing outwardly from said first region and, (e) further means mounted on the vehicle for supporting said sensing means, and means for orientating said supporting means to cause said common axis to be orientated approximately in the direction of the velocity of the vehicle relative to the target.

* * * * *